US008787801B2

(12) United States Patent
Mase

(10) Patent No.: US 8,787,801 B2
(45) Date of Patent: Jul. 22, 2014

(54) DEVELOPING APPARATUS AND DEVELOPER CARTRIDGE

(75) Inventor: Soichiro Mase, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/279,762

(22) Filed: Oct. 24, 2011

(65) Prior Publication Data

US 2012/0039632 A1 Feb. 16, 2012

Related U.S. Application Data

(62) Division of application No. 12/625,607, filed on Nov. 25, 2009, now Pat. No. 8,086,144.

(30) Foreign Application Priority Data

Nov. 27, 2008 (JP) ..... 2008-303089
Jun. 30, 2009 (JP) ..... 2009-156055

(51) Int. Cl.
*G03G 15/06* (2006.01)

(52) U.S. Cl.
USPC ..... 399/254; 399/110; 399/258; 399/263

(58) Field of Classification Search
USPC ..... 399/108, 110, 119, 120, 252–254, 257, 399/258, 260, 262, 263
See application file for complete search history.

(56) References Cited

U.S. PATENT DOCUMENTS 5,506,665 A 4/1996 Ishida et al.
7,502,576 B2 3/2009 Kubota et al.
2002/0025197 A1 2/2002 Mizoguchi et al.
2007/0031168 A1* 2/2007 Koyama ..... 399/254
2007/0189811 A1 8/2007 Sato
2008/0145109 A1* 6/2008 Murayama et al. ..... 399/260

(Continued)

FOREIGN PATENT DOCUMENTS

JP 05-341644 12/1993
JP 05-341650 12/1993

(Continued)

OTHER PUBLICATIONS

Notification of Reasons for Refusal for corresponding Japanese Patent Application 2008-303089 mailed Sep. 14, 2010.

(Continued)

*Primary Examiner* — Walter L Lindsay, Jr.
*Assistant Examiner* — Jessica L Eley
(74) *Attorney, Agent, or Firm* — Banner & Witcoff, Ltd.

(57) ABSTRACT

A developing apparatus includes a developing roller and a feed roller accommodated in a developing chamber of a developing frame, a first agitating member accommodated in a storing chamber of the developing frame for agitating the developer by rotating in a prescribed rotational direction while moving the developer in the rotational direction, a second agitating member accommodated in a developer accommodation chamber of a developer cartridge, a wall portion provided between the storing chamber and the developer accommodation chamber and formed with an opening for circulating the developer between the storing chamber and the developer accommodation chamber to face the storing chamber on a position above the upper end portion of the feed roller, and a conveyance member arranged between the opening of the wall portion and the developer accommodation chamber for conveying the developer in an axial direction of the developing roller.

12 Claims, 14 Drawing Sheets

(56) References Cited

U.S. PATENT DOCUMENTS

| | | | | |
|---|---|---|---|---|
| 2008/0187332 | A1 | 8/2008 | Tsuda et al. | |
| 2008/0240790 | A1 | 10/2008 | Nishiyama et al. | |
| 2010/0003057 | A1 * | 1/2010 | Okuda et al. | 399/263 |

FOREIGN PATENT DOCUMENTS

| | | |
|---|---|---|
| JP | 06-161331 | 6/1994 |
| JP | 07-306578 | 11/1995 |
| JP | 08-234553 | 9/1996 |
| JP | 08-278698 | 10/1996 |
| JP | 09-319202 | 12/1997 |
| JP | 2000-275957 | 6/2000 |
| JP | 2001-117368 | 4/2001 |
| JP | 2002-333764 | 11/2002 |
| JP | 2005-077572 | 3/2005 |
| JP | 2006-106601 | 4/2006 |
| JP | 2006-178505 | 7/2006 |
| JP | 2007-148182 | 6/2007 |
| JP | 2007-212966 | 8/2007 |
| JP | 4065474 | 1/2008 |
| JP | 2008-145606 | 6/2008 |

OTHER PUBLICATIONS

Notification of Reasons for Refusal for corresponding Japanese Patent Application 2008-303089 mailed Apr. 12, 2011.

Notification of Reasons for Refusal issued in Japanese Patent Application No. 2009-156055 dated May 28, 2013.

* cited by examiner

DEVELOPING APPARATUS AND DEVELOPER CARTRIDGE

CROSS REFERENCE TO RELATED APPLICATION

This application is a divisional application of prior U.S. application Ser. No. 12/625,607, filed Nov. 25, 2009, which claims priority to Japanese Patent Application No. 2008-303089 filed on Nov. 27, 2008 and Japanese Patent Application No. 2009-156055 filed on Jun. 30, 2009, the disclosure of which is hereby incorporated into the present application.

TECHNICAL FIELD

The present invention relates to a developing apparatus and a developer cartridge.

BACKGROUND

An electrophotographic image forming apparatus such as a laser printer includes a photosensitive drum on which an electrostatic latent image is formed and a developing apparatus for developing the electrostatic latent image formed on the photosensitive drum.

The developing apparatus includes a case providing a developing chamber and a toner cartridge (a developer cartridge) detachably mounted on the case. A developing roller is rotatably supported in the developing chamber. The peripheral surface of the developing roller is partially exposed from the case, and the exposed portion is in contact with the surface of the photosensitive drum.

The toner cartridge is provided therein with an agitating member for feeding a toner accommodated in the toner cartridge into the developing chamber while agitating the same. The toner fed from the toner cartridge into the developing chamber is carried on the developing roller, and fed from the developing roller to the photosensitive drum while the electrostatic latent image formed on the photosensitive drum is opposed to the developing roller.

As an example of a conventional developing apparatus, there is proposed a developing apparatus having a toner feeding hole and a toner suction hole provided on both axial end portions of a developing roller in a case for connecting a developing chamber and a toner cartridge with each other and an auger member arranged on a position of the developing chamber close to the toner feeding hole and the toner suction hole to extend along the axial direction of a feed roller.

In the developing apparatus, a toner fed into the developing chamber through the toner feeding hole is conveyed along the axial direction of the auger member. The toner in the developing chamber is conveyed along the axial direction of the auger member, and returned to the toner cartridge through the toner suction hole.

However, the toner in the toner cartridge is regularly fed into the developing chamber following rotation of the agitating member. Therefore, the level of the toner in the developing chamber is regularly kept higher than the level of the toner in the toner cartridge. The levels of the toner in the developing chamber and that in the toner cartridge are regularly different from each other, and hence the toner cannot freely move between the developing chamber and the toner cartridge, and it is apprehended that the toner cannot be excellently circulated between the developing chamber and the toner cartridge.

In another conventional developing apparatus, a toner inlet port is formed on a case. On the other hand, a toner outlet port is formed on a toner cartridge. When the toner cartridge is mounted on the case, the toner inlet port and the toner outlet port are opposed to each other, so that the toner cartridge and the case communicate with each other.

The toner cartridge accommodates a toner, while an agitating member is rotatably provided therein. Following rotation of the agitating member, the toner in the toner cartridge is conveyed to a agitating chamber provided in the case through the toner outlet port and the toner inlet port.

An agitator is provided in the agitating chamber. The toner conveyed into the agitating chamber is agitated by the agitator in the agitating chamber, and introduced into the developing chamber.

Following the rotation of the agitating member, however, the toner is directly conveyed from the toner cartridge into the case. Even if the case is filled with the toner, therefore, the toner is continuously fed from the toner cartridge into the case. Consequently, the toner may be excessively fed into the case, and the pressure in the case may be excessively increased. If the pressure in the case is excessively increased, the toner cannot be excellently agitated in the case, and hence the toner may not be normally charged, but may cause reduction of image quality.

SUMMARY

One aspect of the present invention may provide a developing apparatus capable of excellently circulating a developer.

The same or different aspect of the present invention may provide a developer cartridge capable of preventing a member including a developing roller from excess feeding of a developer.

The same or different aspect of the present invention may provide a developing apparatus including: a developing frame providing a developing chamber and a storing chamber for storing a developer fed into the developing chamber; a developing roller accommodated in the developing chamber for carrying a nonmagnetic one-component developer; a feed roller accommodated in the developing chamber for feeding the developer to the developing roller; a first agitating member accommodated in the storing chamber for agitating the developer by rotating in a prescribed rotational direction while moving the developer in the rotational direction; a developer cartridge internally providing a developer accommodation chamber accommodating a developer to be fed into the storing chamber; a second agitating member accommodated in the developer accommodation chamber for agitating the developer in the developer accommodation chamber; a wall portion provided between the storing chamber and the developer accommodation chamber and formed with an opening for circulating the developer between the storing chamber and the developer accommodation chamber to face the storing chamber on a position above the upper end portion of the feed roller; and a conveyance member arranged between the opening of the wall portion and the developer accommodation chamber for conveying the developer in an axial direction of the developing roller.

The same or different aspect of the present invention may provide a developer cartridge detachably mounted on a member including a developing roller. The developer cartridge includes: a longitudinal accommodation chamber accommodating a developer; a tubular conveyance chamber provided along a longitudinal direction of the accommodation chamber through a partition wall to communicate with the accommodation chamber through two openings formed in the partition wall at an interval in the longitudinal direction; a first conveyance member arranged in the accommodation chamber for conveying the developer in the accommodation chamber to the conveyance chamber through one of the openings; and a second conveyance member arranged in the conveyance chamber for conveying the developer in the conveyance chamber from one of the openings toward the other opening. A communication port connecting the conveyance chamber with an external device is formed on a wall of the conveyance chamber between projected portions of the two openings projected on the wall.

The same or different aspect of the present invention provides a developing apparatus including: a developing frame providing a developing chamber and a storing chamber for storing a developer fed into the developing chamber; a developing roller accommodated in the developing chamber for carrying the developer; a feed roller accommodated in the developing chamber for feeding the developer to the developing roller; a first agitating member accommodated in the storing chamber for agitating the developer by rotating in a prescribed rotational direction; an accommodation chamber frame internally providing a developer accommodation chamber accommodating a developer to be fed into the storing chamber; a second agitating member accommodated in the developer accommodation chamber for agitating the developer in the developer accommodation chamber; a wall portion provided between the storing chamber and the developer accommodation chamber and formed with an opening to face the storing chamber on a position above the upper end portion of the feed roller; and a conveyance member arranged between the opening of the wall portion and the developer accommodation chamber for conveying the developer in an axial direction of the developing roller.

DETAILED DESCRIPTION

Embodiments of the present invention are now described with reference to the drawings.

-First Embodiment-

1. Overall Structure of Laser Printer

Figure 1:
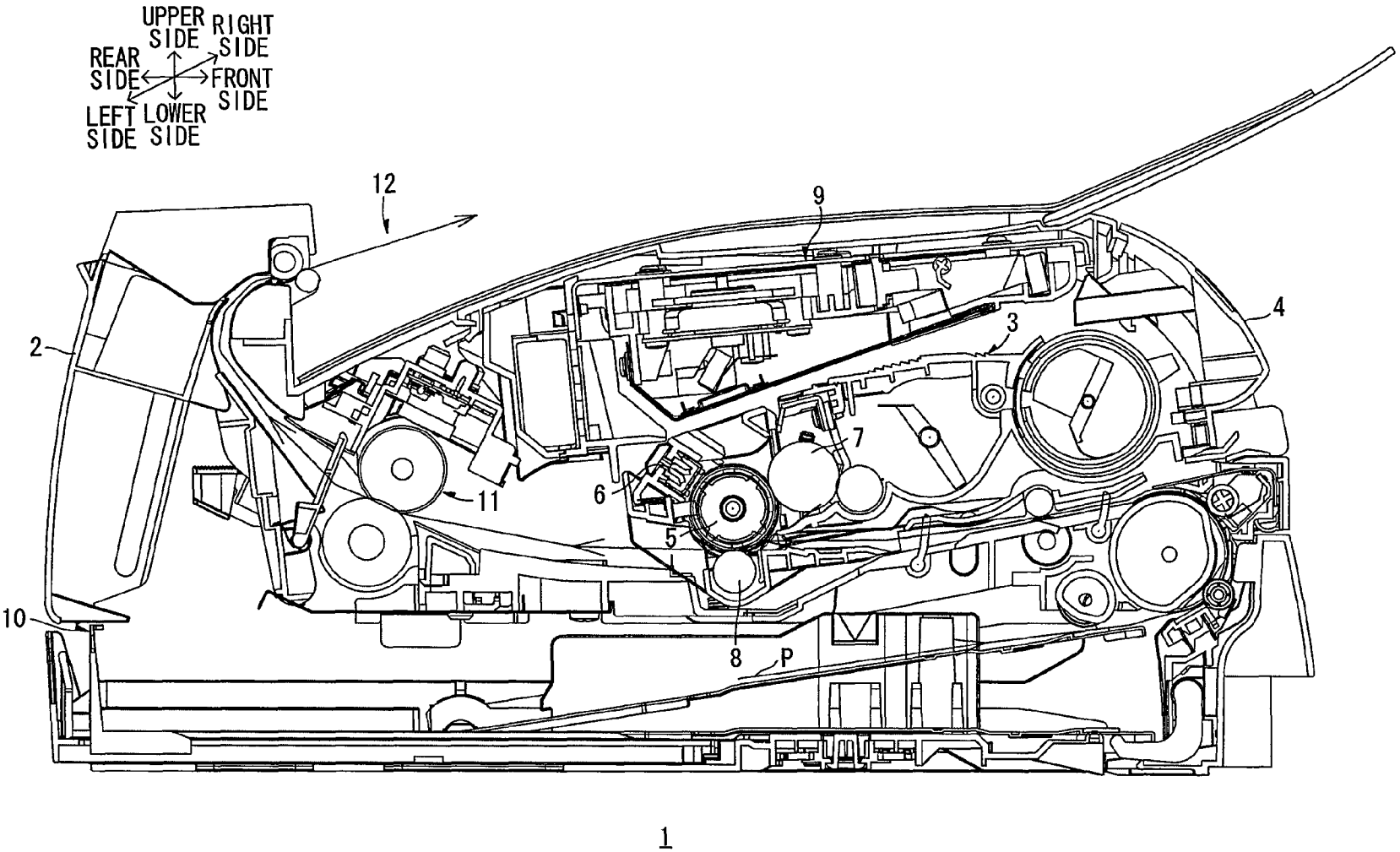
FIG. 1 is a side sectional view of a laser printer.

As shown in FIG. 1, a laser printer 1 includes a main body casing 2. A process cartridge 3 is provided in the main body casing 2. The process cartridge 3 is detachably mountable on the main body casing 2 in a state opening a front cover 4 provided on one sidewall of the main body casing 2.

In the description of the structure shown in FIGS. 1 to 9, it is assumed that the side provided with the front cover 4 is the front side, and the side opposite thereto is the rear side. The right and left sides are defined with reference to the laser printer 1 as viewed from the front side. The right-and-left direction is hereinafter referred to as a width direction. The process cartridge 3 is described with reference to a state mounted on the laser printer 1.

The process cartridge 3 includes a photosensitive drum 5. In the process cartridge 3, a scorotron charger 6, a developing roller 7 and a transfer roller 8 are opposed to the peripheral surface of the photosensitive drum 5.

A scanner unit 9 is arranged above the process cartridge 3.

Following rotation of the photosensitive drum 5, the peripheral surface of the photosensitive drum 5 is uniformly charged by the scorotron charger 6, and thereafter exposed to a laser beam emitted from the scanner unit 9. Thus, an electrostatic latent image based on image data is formed on the peripheral surface of the photosensitive drum 5. When the electrostatic latent image is opposed to the developing roller 7 following the rotation of the photosensitive drum 5, a toner is fed to the electrostatic image, and a toner image is formed on the peripheral surface of the photosensitive drum 5.

A paper transport cassette 10 accommodating sheets P is arranged on the bottom portion of the main body casing 2. Each sheet P accommodated in the paper transport cassette 10 is conveyed to a transfer position between the photosensitive drum 5 and the transfer roller 8 by various rollers. When opposed to the sheet P, the toner image formed on the surface of the photosensitive drum 5 is transferred to the sheet P by a transfer bias applied to the transfer roller 8.

In the main body casing 2, a fuser 11 is provided at the back of the process cartridge 3. The sheet P having the transferred toner image is conveyed to the fuser 11. The fuser 11 fixes the toner image to the sheet P by heating and pressurization. The sheet P having the fixed toner image is ejected to a paper ejection (output) tray 12 provided on the upper surface of the main body casing 2 by various rollers.

2. Process Cartridge (1) Overall Structure of Process Cartridge

Figure 2:
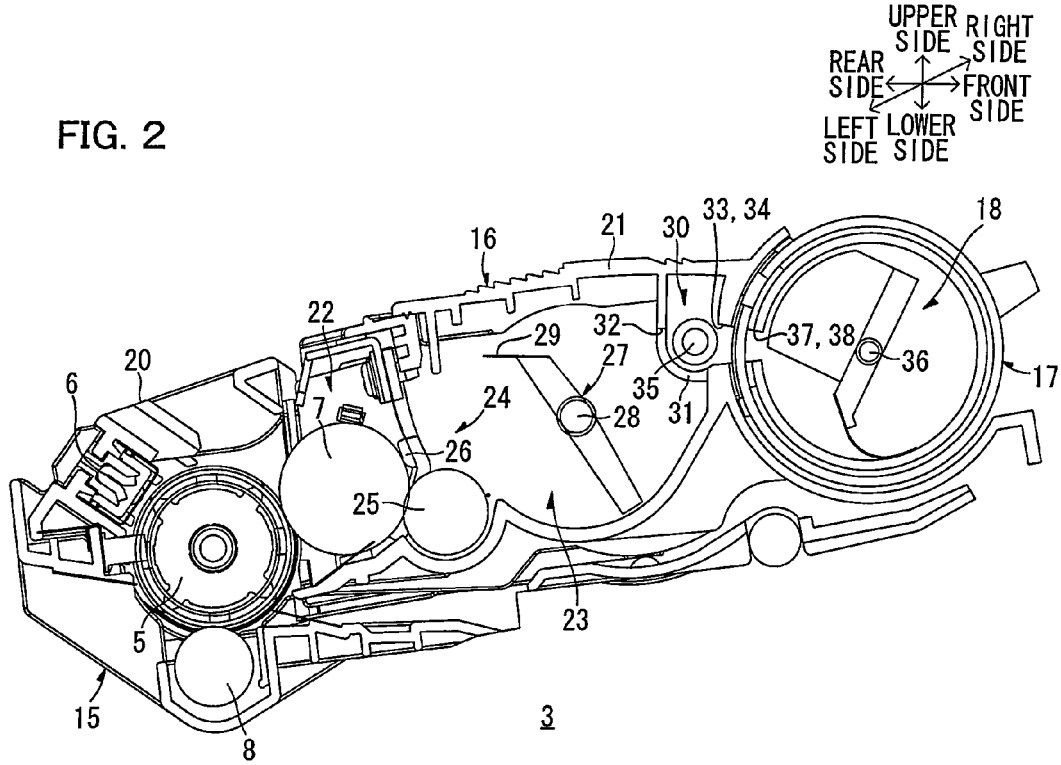
FIG. 2 is a central sectional view of a process cartridge including a developing cartridge according to a first embodiment of the present invention.

As shown in FIG. 2, the process cartridge 3 includes a drum cartridge 15 and a developing cartridge 16 as an example of a developing apparatus detachably mounted on the drum cartridge 15 from behind.

(1-1) Drum Cartridge

The drum cartridge 15 includes a drum frame 20 opened frontward. The photosensitive drum 5, the scorotron charger 6 and the transfer roller 8 are provided in the drum frame 20. The photosensitive drum 5 extends in the width direction, and is rotatably held by the drum frame 20. The scorotron charger 6 is arranged on a position above the rear side of the photosensitive drum 5. The transfer roller 8 extends in the width direction, and is brought into pressure contact with the photosensitive drum 5 from below.

(1-2) Developing Cartridge

The developing cartridge 16 includes an anteroposteriorly extending developing frame 21 opened rearward. The developing frame 21 is partitioned into a rear developing chamber 22 and a front storing chamber 23. The developing chamber 22 and the storing chamber 23 communicate with each other through a developing chamber side communication port 24.

The developing roller 7, a feed roller 25 and a layer-thickness regulating blade 26 are provided in the developing chamber 22. The developing roller 7 and the feed roller 25 extend in the width direction, and are rotatably held by the developing frame 21. The peripheral surface of the developing roller 7 is partially exposed rearward from the developing frame 21, and in contact with the peripheral surface of the photosensitive drum 5. The feed roller 25 is in pressure contact with the developing roller 7 from below the front side at the back of the developing chamber side communication port 24. The base end portion of the layer-thickness regulating blade 26 is fixed to an upper portion in the developing frame 21, while the forward end portion thereof is in pressure contact with the peripheral surface of the developing roller 7.

The storing chamber 23 stores a nonmagnetic one-component positively charged toner (a developer). Further, the storing chamber 22 is provided with an agitator 27 as an example of a first agitating member for agitating the toner in the storing chamber 22. The agitator 27 includes an agitator rotating shaft 28 and a flexible agitating blade 29 rotated around the agitator rotating shaft 28. The agitating blade 29 has a size (a length in the radial direction of the agitator rotating shaft 28) for interfering with an opening 32 formed in a wall portion 31 of a conveyance chamber 30 described below.

Figure 3:
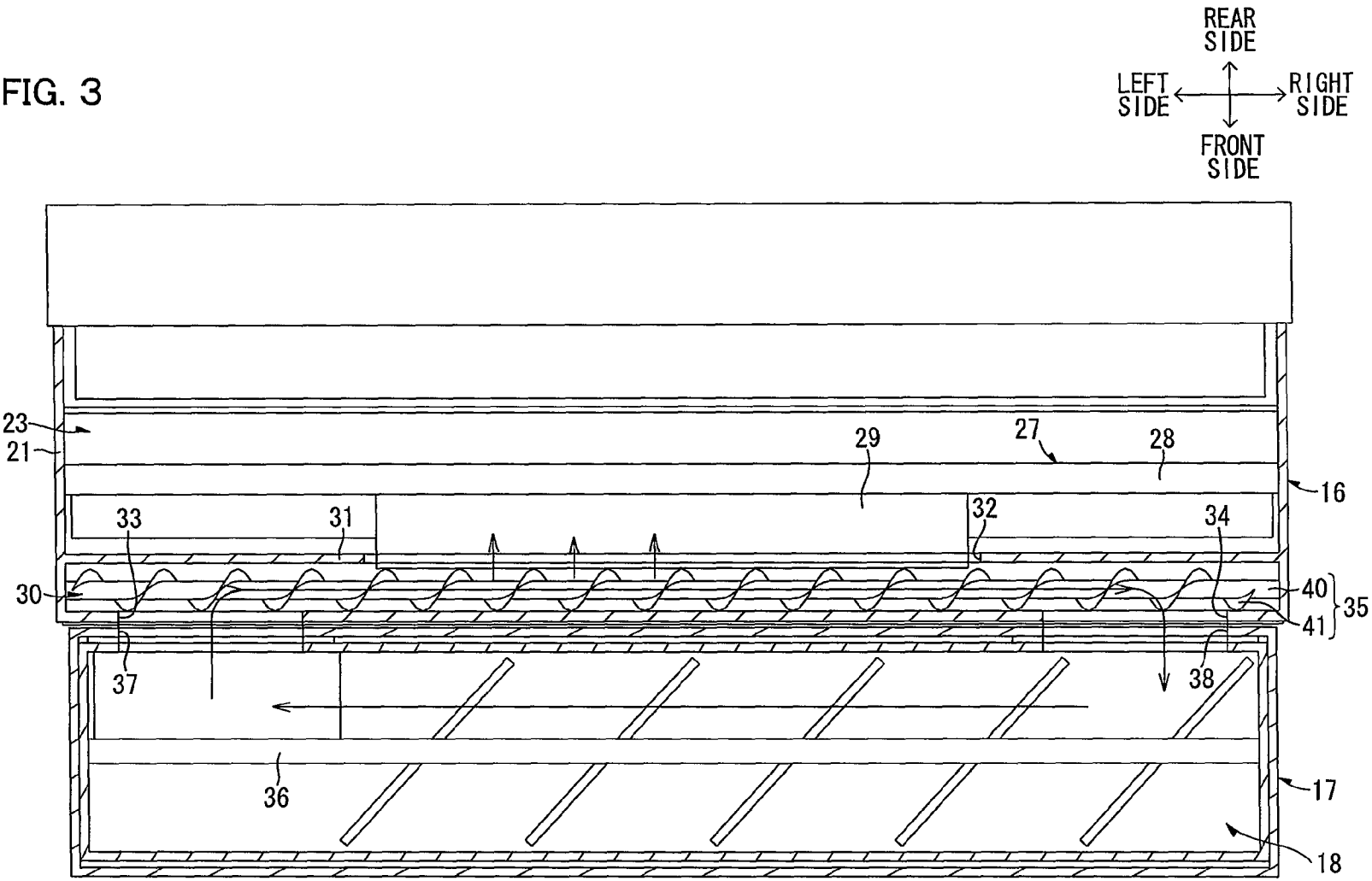
FIG. 3 is a plane cross-sectional view of the developing cartridge shown in FIG. 2.

In the developing cartridge 16, the conveyance chamber 30 is provided on a position above the front side of the storing chamber 23. The conveyance chamber 30 is partitioned by the wall portion 31 and the developing frame 21. A conveyance auger 35 as an example of a conveyance member is provided in the conveyance chamber 30. As shown in FIG. 3, the conveyance auger 35 has an auger rotating shaft 40 extending in the width direction and an auger tooth 41, rotating around the auger rotating shaft 40, spirally extending from the side of one end portion toward the side of another end portion in the width direction.

The wall portion 31 extends downward from the upper wall of the developing frame 21, and the lower end portion thereof is bent frontward and coupled to the front wall of the developing frame 21. The wall portion 31 is arranged on a position above the feed roller 25 in side elevational view. As shown in FIGS. 2 and 3, the opening 32 vertically connecting the conveyance chamber 30 and the storing chamber 23 with each other is formed in a central portion of the wall portion 31 in the width direction.

A toner feeding hole 33 and a toner suction hole 34 as examples of a communication port are formed on both end portions of a front portion (the front wall of the developing frame 21) of the conveyance chamber 30 in the width direction respectively. More specifically, the toner feeding hole 33 is formed on the left end portion of the front wall of the developing frame 21. The toner suction hole 34 is formed on the right end portion of the front wall of the developing frame 21.

(1-3) Toner Cartridge

The developing cartridge 16 includes a toner cartridge 17 as an example of a developer cartridge detachably mounted on the developing frame 21 from behind.

The toner cartridge 17 is in the form of a cylinder extending in the width direction. The internal space of the toner cartridge 17 defines a toner accommodation chamber 18 as an example of a developer accommodation chamber accommodating the nonmagnetic one-component toner. An auger member 36 as an example of a second agitating member for agitating the toner in the toner accommodation chamber 18 is provided in the toner accommodation chamber 18. As shown in FIG. 3, the auger member 36 has an auger tooth spirally extending from the side of one end portion toward the side of another end portion in the width direction.

In the rear portion of the toner cartridge 17, a cartridge side feeding hole 37 is formed on a position opposed to the toner feeding hole 33 of the developing cartridge 16 (the conveyance chamber 30). Thus, the toner accommodation chamber 18 and the conveyance chamber 30 communicate with each other through the cartridge side feeding hole 37 and the toner feeding hole 33. In the rear portion of the toner cartridge 17, further, a cartridge side suction hole 38 is formed on a position opposed to the toner suction hole 34 of the developing cartridge 16. Thus, the toner accommodation chamber 18 and the conveyance chamber 30 communicate with each other through the cartridge side suction hole 38 and the toner suction hole 34.

3. Toner Path (1) Toner Path Between Storing Chamber and Developing Chamber

The toner stored in the storing chamber 23 is agitated in the storing chamber 23 following rotation of the agitator 27, and partially introduced into the developing chamber 22 through the developing chamber side communication port 24. The toner introduced into the developing chamber 22 is fed to the developing roller 7 through the feed roller 25, due to the contact between the feed roller 25 and the developing roller 7. The toner fed to the developing roller 7 is regulated in thickness by the layer-thickness regulating blade 26 following rotation of the developing roller 7, and carried on the peripheral surface of the developing roller 7 as a thin layer having a constant thickness. When the electrostatic latent image formed on the peripheral surface of the photosensitive drum 5 is opposed to the developing roller 7, therefore, the toner is fed from the developing roller 7 to the electrostatic latent image, to develop the electrostatic latent image.

(2) Toner Path in State where Storing Chamber is Filled with Toner

Figure 4:
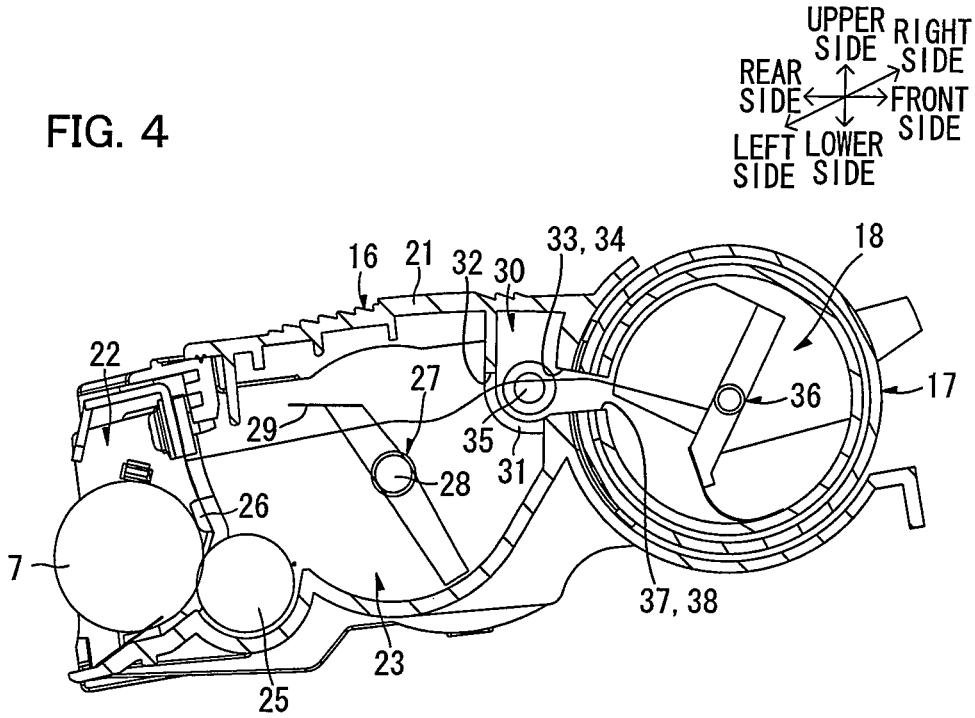
FIG. 4 is a schematic sectional view of the developing cartridge shown in FIG. 2, in a state where a storing chamber is filled with a toner.

When the storing chamber 23 is filled with the toner, the upper end of the level of the toner in the storing chamber 23 is positioned above the opening 32 formed in the wall portion 31, as shown in FIG. 4. Further, the level of the toner in the storing chamber 23 and that of the toner in the toner accommodation chamber 18 are generally identical to each other. In this state, the toner is circulated between the storing chamber 23 and the toner accommodation chamber 18 through the conveyance chamber 30.

(2-1) Toner Path from Toner Accommodation Chamber to Storing Chamber

As shown in FIG. 3, the toner in the toner accommodation chamber 18 is conveyed from right to left in the toner accommodation chamber 18, following rotation of the auger member 36. Then, the toner is introduced into the conveyance chamber 30 through the cartridge side feeding hole 37 formed on the left end portion in the rear portion of the toner cartridge 17 and the toner feeding hole 33 formed on the left end portion in the front portion of the conveyance chamber 30.

The toner introduced into the conveyance chamber 30 is conveyed from left to right in the conveyance chamber 30, following rotation of the conveyance auger 35. Then, the toner is introduced into the storing chamber 23 through the opening 32 formed on a central portion of the rear portion (the wall portion 31) of the conveyance chamber 30 in the width direction.

(2-2) Toner Path from Storing Chamber to Toner Accommodation Chamber

As shown in FIG. 2, the toner in the storing chamber 23 is moved in the rotational direction (the clockwise direction in FIG. 2) of the agitator 27 following rotation thereof. The agitating blade 29 of the agitator 27 is formed to interfere with the opening 32, and hence the toner around the opening 32 in the storing chamber 23 is pushed into the opening 32 due to the interference between the agitating blade 29 of the agitator 27 and the opening 32, and introduced into the conveyance chamber 30.

As shown in FIG. 3, the toner introduced into the conveyance chamber 30 is conveyed from left to right in the conveyance chamber 30, following rotation of the conveyance auger 35. Then, the toner is introduced from the conveyance chamber 30 into the toner accommodation chamber 18 through the toner suction hole 34 formed on the right end portion in the front portion of the conveyance chamber 30 and the cartridge side suction hole 38 formed on the right end portion in the rear portion of the toner cartridge 17.

Thus, the toner is circulated between the storing chamber 23 and the toner accommodation chamber 18 through the conveyance chamber 30.

Figure 5:
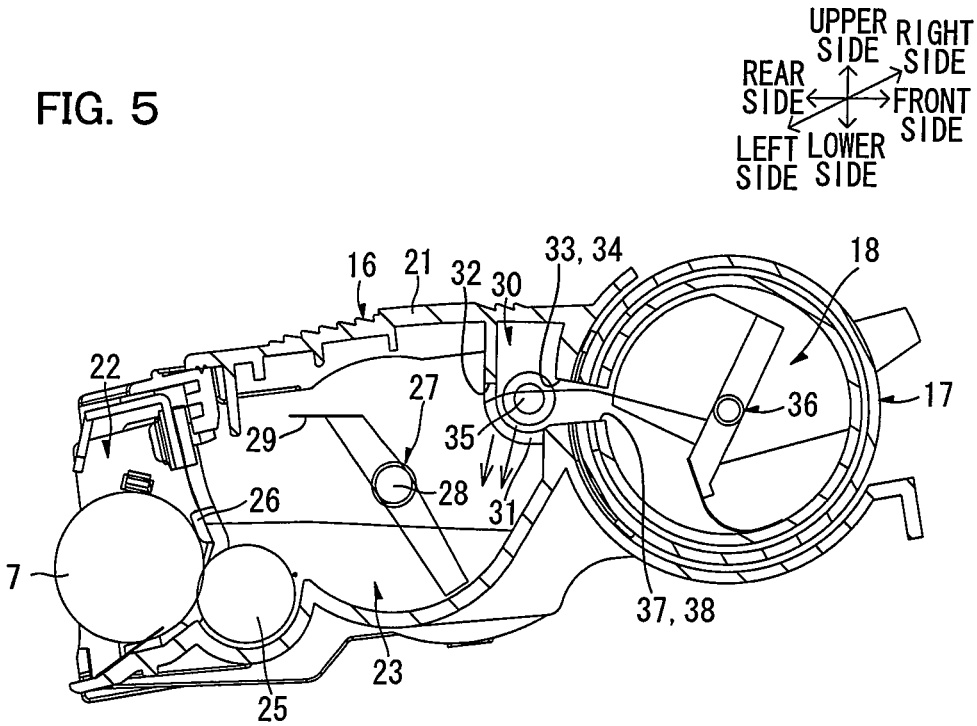
FIG. 5 is a schematic sectional view of the developing cartridge shown in FIG. 2, in a state where the quantity of the toner in the storing chamber is reduced.
Figure 6:
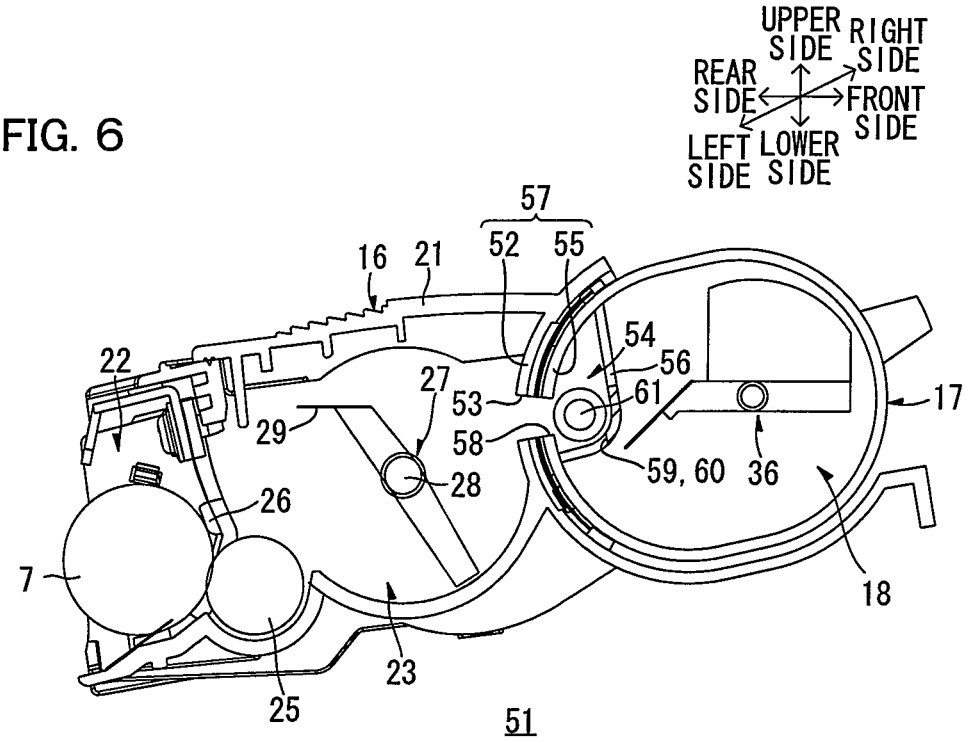
FIG. 6 is a central sectional view of a developing cartridge according to a second embodiment of the present invention.

(3) Toner Path in State where Quantity of Toner in Conveyance Chamber is Reduced When the quantity of the toner in the storing chamber 23 is reduced, the upper end of the level of the toner in the storing chamber 23 is positioned below the opening 32 formed in the wall portion 31, as shown in FIG. 5. In this state, the toner in the toner accommodation chamber 18 is supplied to the storing chamber 23 through the conveyance chamber 30.

As shown in FIG. 3, the toner in the toner accommodation chamber 18 is conveyed from right to left in the toner accommodation chamber 18, following rotation of the auger member 36. Then, the toner is introduced from the toner accommodation chamber 18 into the conveyance chamber 30 through the cartridge side feeding hole 37 formed on the left end portion in the rear portion of the toner cartridge 17 and the toner feeding hole 33 formed on the left end portion in the front portion of the conveyance chamber 30.

The toner introduced into the conveyance chamber 30 is conveyed from left to right in the conveyance chamber 30, following rotation of the conveyance auger 35. Then, the toner is introduced into the storing chamber 23 by free fall through the opening 32 formed in the rear portion (the wall portion 31) of the conveyance chamber 30. Thus, the toner in the toner accommodation chamber 18 is supplied to the storing chamber 23 through the conveyance chamber 30.

4. Functions/Effects

As hereinabove described, the developing cartridge 16 includes the developing frame 21. The developing frame 21 is provided with the developing chamber 22 and the storing chamber 23 for storing the toner fed into the developing chamber 22. The developing chamber 22 accommodates the developing roller 7 and the feed roller 25. The developing roller 7 carries the toner fed by the feed roller 25. The storing chamber 23 accommodates the agitator 27. Following rotation of the agitator 27 in a prescribed rotational direction, the toner in the storing chamber 23 is moved in the rotational direction and agitated.

The toner cartridge 17 is arranged on a side of the storing chamber 23. The toner accommodation chamber 18 accommodating the toner to be fed into the storing chamber 23 is formed in the toner cartridge 17. The toner accommodation chamber 18 accommodates the auger member 36. The auger member 36 agitates the toner in the toner accommodation chamber 18.

The wall portion 31 is provided between the storing chamber 23 and the toner accommodation chamber 18. In the wall portion 31, the opening 32 facing the storing chamber 23 is formed on the position above the upper end portion of the feed roller 25. Further, the conveyance auger 35 is arranged between the opening 32 of the wall portion 31 and the toner accommodation chamber 18. The toner is conveyed by the conveyance auger 35 along the axial direction of the developing roller 7.

When the level of the toner in the storing chamber 23 is positioned below the opening 32 of the wall portion 31 following the use of the developing cartridge 16 (the process cartridge 3), therefore, the toner in the toner accommodation chamber 18 is conveyed by the conveyance auger 35 in the axial direction of the developing roller 7 and supplied to the storing chamber 23 through the opening 32 of the wall portion 31.

When the toner is so supplied from the toner accommodation chamber 18 to the storing chamber 23 that the level of the toner in the storing chamber 23 is generally identical to that of the toner in the toner accommodation chamber 18, the toner is circulated between the storing chamber 23 and the toner accommodation chamber 18 through the opening 32 of the wall portion 31. In other words, the toner in the toner accommodation chamber 18 is agitated by the auger member 36 and transferred to the conveyance auger 35. Then, the toner is conveyed by the conveyance auger 35 in the axial direction of the developing roller 7, and supplied to the storing chamber 23 through the opening 32 of the wall portion 31. On the other hand, the toner in the storing chamber 23 is moved by the agitator 27 in the rotational direction thereof, to be transferred to the conveyance auger 35 through the opening 32 of the wall portion 31. Then, the toner is conveyed by the conveyance auger 35 in the axial direction of the developing roller 7, and returned to the toner accommodation chamber 18. Consequently, the toner can be excellently circulated between the toner accommodation chamber 18 and the storing chamber 23.

The conveyance auger 35 has the auger rotating shaft 40 extending in the axial direction of the developing roller 7, and conveys the toner by rotating around the auger rotating shaft 40. Thus, the toner can be excellently conveyed along the axial direction of the developing roller 7.

The process cartridge 3 includes the conveyance chamber 30 accommodating the conveyance auger 35. The conveyance chamber 30 has the cartridge side feeding hole 37 and the cartridge side suction hole 38 communicating with the toner accommodation chamber 18. The wall of the conveyance chamber 30 is partially constituted of the wall portion 31. Further, the conveyance chamber 30 communicates with the storing chamber 23 through the opening 32. Thus, the toner in the toner accommodation chamber 18 is fed into the conveyance chamber 30 through the cartridge side feeding hole 37, conveyed in the conveyance chamber 30 along the axial direction of the conveyance auger 35, and fed into the storing chamber 23 through the opening 32 of the wall portion 31. On the other hand, the toner in the storing chamber 23 is introduced into the conveyance chamber 30 through the opening 32 of the wall portion 31, conveyed in the conveyance chamber 30 along the axial direction of the conveyance auger 35, and returned to the toner accommodation chamber 18 through the cartridge side suction hole 38.

The agitator 27 has the flexible agitating blade 29. The opening 32 is formed on the position interfering with the agitating blade 29. The toner moved in the rotational direction of the agitator 27 following rotation thereof is pushed into the conveyance chamber 30 through the opening 32 due to the elasticity of the agitating blade 29, when the agitating blade 29 interferes with the opening 32. Thus, the toner around the opening 32 can be reliably pushed into the conveyance chamber 30 through the opening 32.

The opening 32 is directed downward. Thus, the toner in the toner accommodation chamber 18 can be excellently supplied to the storing chamber 23 by free fall.

The conveyance auger 35 unidirectionally conveys the toner in the axial direction of the conveyance auger 35. The opening 32 is formed on a position opposed to the central portion of the conveyance auger 35 in the axial direction. Further, the cartridge side feeding hole 37 and the cartridge side suction hole 38 are formed on the positions opposed to both end portions of the conveyance auger 35 in the axial direction respectively.

Thus, the toner in the toner accommodation chamber 18 is introduced into the conveyance chamber 30 through the cartridge side feeding hole 37, and conveyed from right to left by the conveyance auger 35 along the axial direction thereof. Then, the toner is introduced from the conveyance chamber 30 into the storing chamber 23 through the opening 32 formed on the position opposed to the central portion of the conveyance auger 35 in the axial direction. On the other hand, the toner in the storing chamber 23 is introduced into the conveyance chamber 30 through the opening 32, and conveyed from left to right by the conveyance auger 35 along the axial direction thereof. Then, the toner is returned from the conveyance chamber 30 to the toner accommodation chamber 18 through the cartridge side suction hole 38. Consequently, the toner can be excellently circulated along the circulation path.

-Second Embodiment-

Referring to FIGS. 6 to 9, portions corresponding to those shown in FIGS. 2 to 5 are denoted by reference numerals identical to those of the portions shown in FIGS. 2 to 5, and redundant description of these portions is omitted.

1. Storing Chamber

In the process cartridge 3 shown in FIG. 2, the conveyance chamber 30 is partitioned by the wall portion 31 and the developing frame 21 on the position above the front side of the storing chamber 23. In a process cartridge 51 shown in FIG. 6, on the other hand, the conveyance chamber 30 and the wall portion 31 are omitted.

Figure 7:
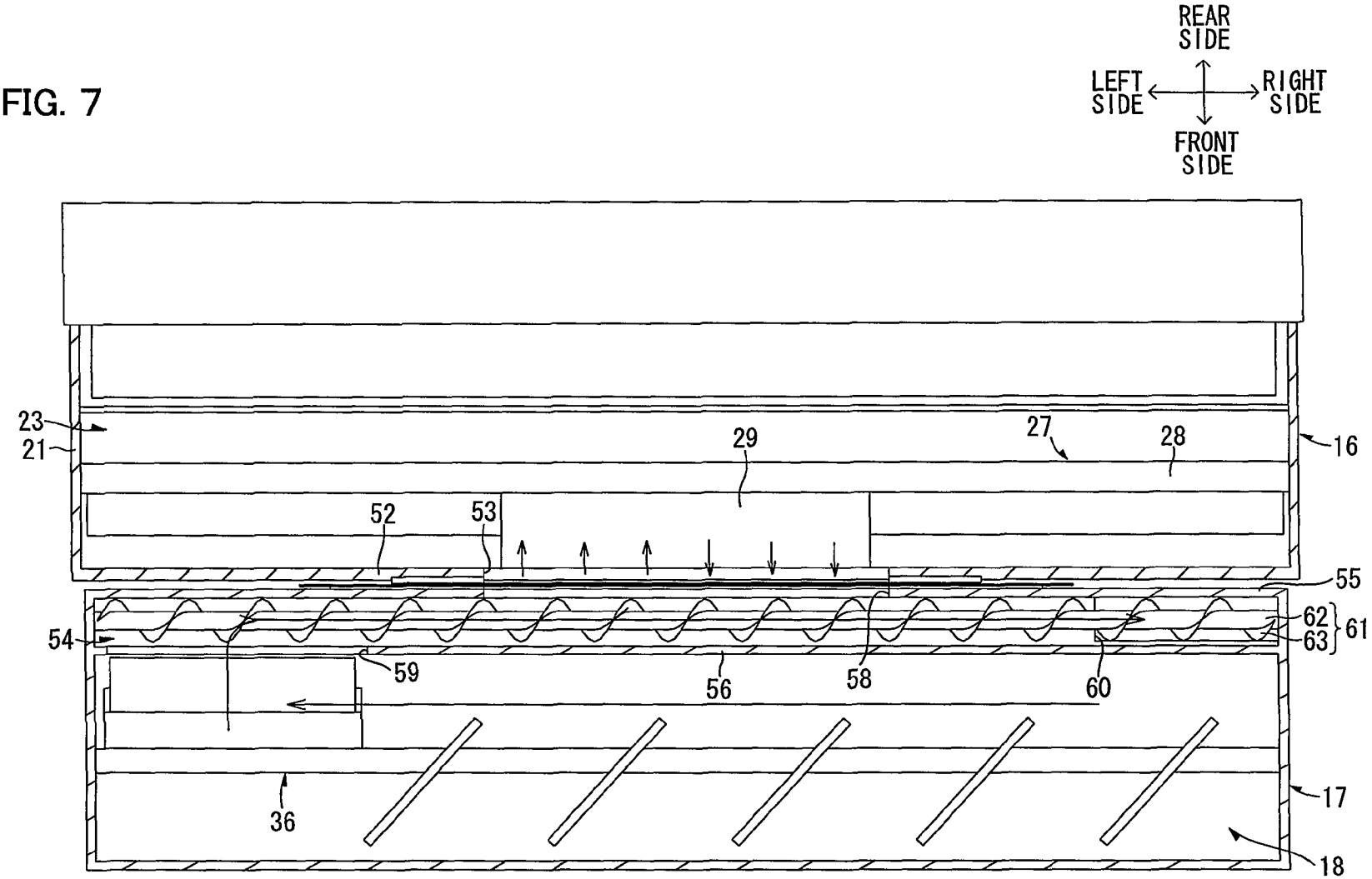
FIG. 7 is a plane cross-sectional view of the developing cartridge shown in FIG. 6.

A portion of the front wall of a developing frame 21 facing a storing chamber 23 forms a first wall portion 52 as an example of a wall portion. In the first wall portion 52, a developing side opening 53 as an example of an opening anteroposteriorly penetrating the first wall portion 52 is formed on a position above the upper end portion of a feed roller 25. As shown in FIG. 7, the developing side opening 53 is positioned on a generally central portion of the developing frame 21 in the width direction.

2. Toner Cartridge

In a toner cartridge 17, a conveyance chamber 54 is provided on a rear upper position. The conveyance chamber 54 is partitioned by a second wall portion 55 as an example of a wall portion and a partition wall 56. A conveyance auger 61 as an example of a conveyance member is provided in the conveyance chamber 54. As shown in FIG. 7, the conveyance auger 61 includes an auger rotating shaft 62 extending in the width direction and an auger tooth 63, rotating around the auger rotating shaft 62, spirally extending from the side of one end portion toward the side of another end portion in the width direction.

The second wall portion 55 is constituted of a rear upper portion of the toner cartridge 17, and forms a wall portion 57 in association with the first wall portion 52 of the developing cartridge 16. In the second wall portion 55, a cartridge side opening 58 as an example of an opening is formed on a position opposed to the developing side opening 53 of the first wall portion 52. Thus, the conveyance chamber 54 and the storing chamber 23 anteroposteriorly communicate with each other through the developing side opening 53 and the cartridge side opening 58.

The partition wall 56 extends downward from the upper wall of the toner cartridge 17, and the lower end portion thereof is bent rearward and coupled to the front wall of the toner cartridge 17. A toner feeding hole 59 and a toner suction hole 60 as examples of a communication port are formed on both end portions of the partition wall 56 in the width direction to vertically penetrate the partition wall 56 respectively. More specifically, the toner feeding hole 59 is formed on the left end portion of the partition wall 56. The toner suction hole 60 is formed on the right end portion of the partition wall 56. Thus, the conveyance chamber 54 and the toner accommodation chamber 18 vertically communicate with each other through the toner feeding hole 59 and the toner suction hole 60.

Figure 8:
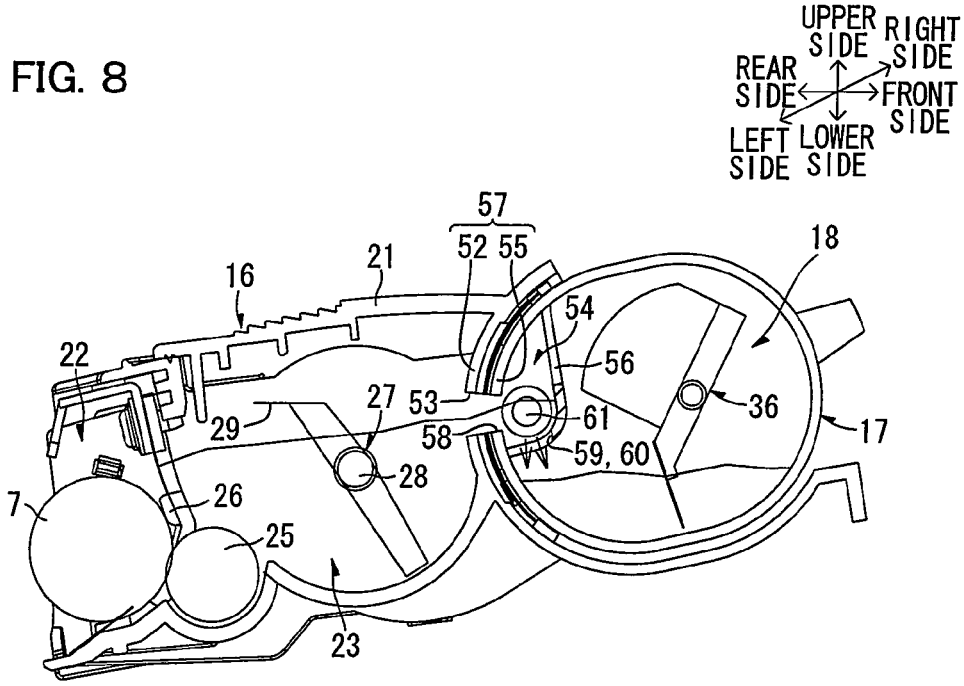
FIG. 8 is a schematic sectional view of the developing cartridge shown in FIG. 6, in a state where a storing chamber is filled with a toner.

3. Toner Path (1) Toner Path in State where Storing Chamber is Filled with Toner When the storing chamber 23 is filled with the toner, the upper end of the level of the toner in the storing chamber 23 is positioned above the developing side opening 53 and the cartridge side opening 58 (hereinafter also simply referred to as "openings 53 and 58") formed in the wall portion 57 (the first wall portion 52 and the second wall portion 55), as shown in FIG. 8. In this state, the toner is circulated between the storing chamber 23 and the toner accommodation chamber 18 through the conveyance chamber 54.

(1-1) Toner Path from Toner Accommodation Chamber to Storing Chamber

As shown in FIG. 7, the toner in the toner accommodation chamber 18 is conveyed from right to left in the toner accommodation chamber 18, following rotation of the auger member 36. Then, the toner is introduced from the toner accommodation chamber 18 into the conveyance chamber 54 through the toner feeding hole 59 formed on the left end portion of the partition wall 56 of the toner cartridge 17.

The toner introduced into the conveyance chamber 54 is conveyed from left to right in the conveyance chamber 54, following rotation of the conveyance auger 61. Then, the toner is introduced from the conveyance chamber 54 into the storing chamber 23 through the openings 53 and 58 formed in the wall portion 57 of the conveyance chamber 54.

(1-2) Toner Path from Storing Chamber to Toner Accommodation Chamber

The toner in the storing chamber 23 is introduced into the conveyance chamber 54 through the openings 53 and 58, following rotation of the agitator 27.

The toner introduced into the conveyance chamber 54 is conveyed from left to right in the conveyance chamber 54, following rotation of the conveyance auger 61. Then, the toner is introduced from the conveyance chamber 54 into the toner accommodation chamber 18 through the toner suction hole 60 formed on the right end portion of the partition wall 56 of the conveyance chamber 54.

Thus, the toner is circulated between the storing chamber 23 and the toner accommodation chamber 18 through the conveyance chamber 54.

(2) Toner Path in State where Quantity of Toner in Storing Chamber is Reduced

Figure 9:
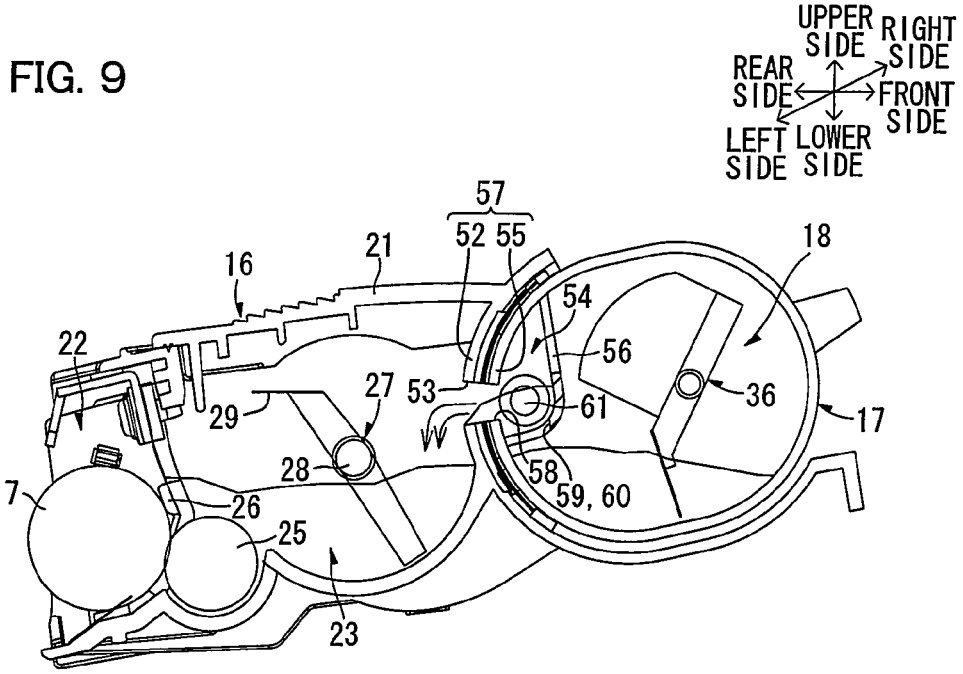
FIG. 9 is a schematic sectional view of the developing cartridge shown in FIG. 6, in a state where the quantity of the toner in the storing chamber is reduced.

When the quantity of the toner in the storing chamber 23 is reduced, the upper end of the level of the toner in the storing chamber 23 is positioned below the openings 53 and 58 formed in the wall portion 57, as shown in FIG. 9. In this state, the toner is supplied from the toner accommodation chamber 18 to the storing chamber 23 through the conveyance chamber 54.

As shown in FIG. 7, the toner in the toner accommodation chamber 18 is conveyed from right to left in the toner accommodation chamber 18, following rotation of the auger member 36. Then, the toner is introduced from the toner accommodation chamber 18 into the conveyance chamber 54 through the toner feeding hole 59 formed on the left end portion of the partition wall 56 of the toner cartridge 17.

The toner introduced into the conveyance chamber 54 is conveyed from right to left in the conveyance chamber 54, following rotation of the conveyance auger 61. Then, the toner is introduced from the conveyance chamber 54 into the storing chamber 23 through the openings 53 and 58 formed in the wall portion 57 of the conveyance chamber 54. Thus, the toner is supplied from the toner accommodation chamber 18 to the storing chamber 23 through the conveyance chamber 54.

4. Effects

Also according to the structure of the process cartridge 51 shown in FIGS. 6 to 9, effects similar to those of the process cartridge 3 shown in FIGS. 2 to 5 can be attained.

-Third Embodiment-

1. Overall Structure of Color Printer

Figure 10:
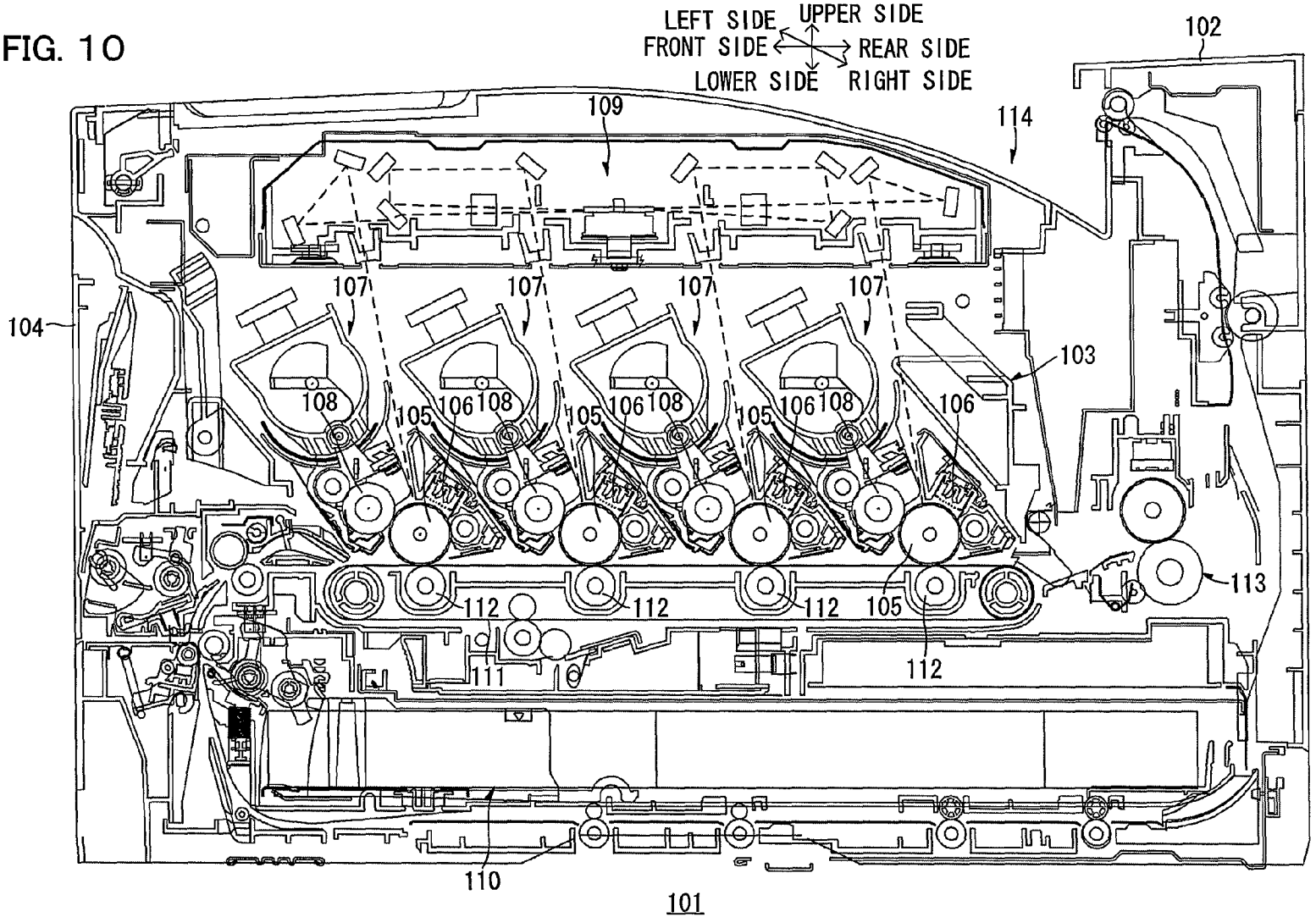
FIG. 10 is a side sectional view of a color printer.

As shown in FIG. 10, a printer 101 is a tandem-type color printer. A drum unit 103 is mounted in a main body casing 102 as an example of an apparatus body of the printer 101. The drum unit 103 is detachably mountable on the main body casing 102 by opening a cover 104 provided on the front surface of the main body casing 102.

In the following description, it is assumed that the side (the left side in FIG. 10) provided with the cover 104 is the front side, and the side (the right side in FIG. 10) opposite thereto is the rear side. The right and left sides are defined with reference to the printer 101 as viewed from the front side. The right-and-left direction may hereinafter be referred to as a width direction.

The drum unit 103 includes four photosensitive drums 105. The four photosensitive drums 105 are provided correspondingly to colors of black, yellow, magenta and cyan respectively, and parallelly arranged in the order of black, yellow, magenta and cyan from the front side at regular intervals along the anteroposterior direction.

The drum unit 103 further includes a scorotron charger 106 and a developing cartridge 107 correspondingly to each photosensitive drum 105. The developing cartridge 107 includes a developing roller 108 for feeding a toner (a developer) to the photosensitive drum 105. Each developing cartridge 107 is detachably mounted on the drum unit 103.

An exposure unit 109 emitting four laser beams corresponding to the respective colors is arranged above the drum unit 103.

Following rotation of each photosensitive drum 105, the peripheral surface of the photosensitive drum 105 is uniformly charged by discharge from the scorotron charger 106, and thereafter selectively exposed by the corresponding laser beam from the exposure unit 109. Due to the exposure, charges are selectively removed from the peripheral surface of the photosensitive drum 105, and an electrostatic latent image is formed on the peripheral surface of the photosensitive drum 105. When the electrostatic latent image is opposed to the developing roller 108, the developing roller 108 feeds the toner to the electrostatic latent image. Thus, a toner image is formed on the peripheral surface of the photosensitive drum 105.

In place of the exposure unit 109, four LED arrays may be provided correspondingly to the photosensitive drums 105 respectively.

A paper transport cassette 110 accommodating sheets P is arranged on the bottom portion of the main body casing 102. Each sheet P accommodated in the paper transport cassette 110 is conveyed onto a conveyance belt 111 by various rollers. The conveyance belt 111 is opposed to the four photosensitive drums 105 from below. Transfer rollers 112 are arranged on positions opposed to the photosensitive drums 105 through an upper portion of the conveyance belt 111 respectively. The sheet P conveyed onto the conveyance belt 111 successively passes through the spaces between the conveyance belt 111 and the photosensitive drums 105, following traveling of the conveyance belt 111. When opposed to the sheet P, the toner images formed on the surfaces of the photosensitive drums 105 are transferred to the sheet P by transfer biases applied to the transfer rollers 112.

A fuser 113 is provided on a downstream side of the conveyance belt 111 in the direction for conveying the sheet P. The sheet P having the transferred toner images is conveyed to the fuser 113. The fuser 113 fixes the toner images to the sheet P by heating and pressurization. The sheet P having the fixed toner images is ejected to a paper ejection (output) tray 114 provided on the upper surface of the main body casing 102 by various rollers.

2. Developing Cartridge

Figure 11:
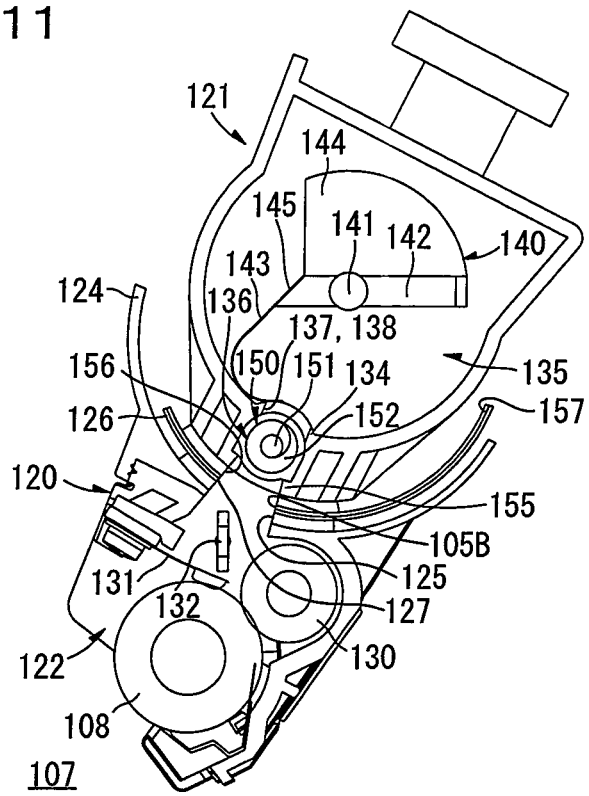
FIG. 11 is a side sectional view of a developing cartridge including a toner cartridge according to a third embodiment of the present invention.

As shown in FIG. 11, each developing cartridge 107 includes a developing frame 120 including the developing roller 108 and a toner cartridge 121 as an example of a developer cartridge detachably mounted on the developing frame 120.

(1) Developing Frame

The developing frame 120 is in the form of a box opened downward toward the rear side, and has a developing chamber 122 therein.

A front upper portion of the developing frame 120 forms an arcuate receiving portion 124 convexed downward toward the rear side. A developing chamber side communication port 125 connecting the developing chamber 122 with an external device is formed on an anteroposterior central portion of the receiving portion 124 to penetrate the receiving portion 124.

The receiving portion 124 is provided with an arcuate first shutter 126 extending along the inner side of the arcuate portion of the receiving portion 124. A first shutter opening 127 generally identical in shape to the developing chamber side communication port 125 is formed in the first shutter 126. The first shutter 126 is slidable along the receiving portion 124 in the peripheral direction of the arc thereof, and displaced between an open position where the first shutter opening 127 is opposed to the developing chamber side communication port 125 and a closed position where the first shutter opening 127 is not opposed to the developing chamber side communication port 125.

The developing roller 108, a feed roller 130, a layer-thickness regulating blade 131 and an agitator 132 are provided in the developing chamber 122.

The developing roller 108 extends in the width direction, and is rotatably held by the developing frame 120. The peripheral surface of the developing roller 108 is partially exposed from the developing frame 120 downward toward the rear side. When the developing cartridge 107 is mounted on the drum unit 103 (see FIG. 10), the portion of the developing roller 108 exposed from the developing frame 120 is in contact with the peripheral surface of the photosensitive drum 105.

The feed roller 130 extends in the width direction, and is rotatably held by the developing frame 120. The feed roller 130 is in pressure contact with the developing roller 108 from above the front side thereof under the front side of the developing chamber side communication port 125.

The base end portion of the layer-thickness regulating blade 131 is fixed to a rear portion in the developing frame 120, while the forward end portion thereof is in pressure contact with the peripheral surface of the developing roller 108.

The agitator 132 extends in the width direction under the developing chamber side communication port 125, and is supported to be rotatable with respect to the developing frame 120.

(2) Toner Cartridge

Figure 12:
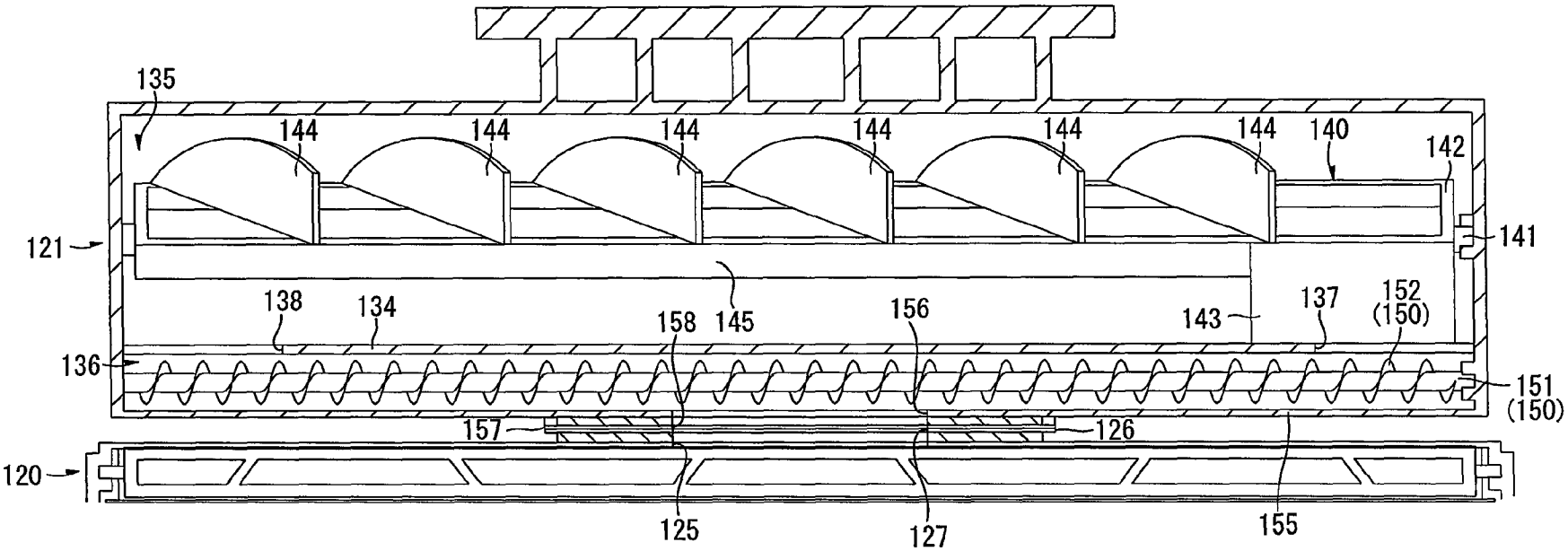
FIG. 12 is a sectional view of the toner cartridge shown in FIG. 11, illustrating a generally vertically cut section of the toner cartridge as viewed from the front side.

As shown in FIGS. 11 and 12, the toner cartridge 121 is in the form of a cylinder extending in the width direction. The internal space of the toner cartridge 121 is partitioned into an upper longitudinal accommodation chamber 135 and a lower tubular conveyance chamber 136 by a partition wall 134 extending in the width direction. The accommodation chamber 135 and the conveyance chamber 135 communicate with each other through a toner feeding hole 137 as an example of an opening provided on the right end portion of the partition wall 134 and a toner suction hole 138 as an example of an opening provided on the left end portion of the partition wall 134.

The accommodation chamber 135 accommodates a non-magnetic one-component toner. The accommodation chamber 135 is provided therein with a first agitating member 140 for conveying the toner from the accommodation chamber 135 to the conveyance chamber 136 through the toner feeding hole 137.

The first agitating member 140 includes a first rotating shaft 141, an agitating member body 142, a first blade 143 and second blades 144.

The first rotating shaft 141 extends in the width direction, and is rotatably supported by the right and left walls of the accommodation chamber 135 (the toner cartridge 121).

The agitating member body 142 is in the form of a plate extending from the first rotating shaft 141 in both sides of a direction (the radial direction) orthogonal to the axial direction thereof, as shown in FIGS. 11 and 12. An end surface of the agitating member body 142 on one side of the radial direction forms an inclined surface 145 inclined in the radial direction.

The first blade 143 is in the form of a flexible film, and mounted on the right end portion of the agitating member body 142 so that one end portion thereof is in contact with the inclined surface 145 of the agitating member body 142. Another end portion of the first blade 143 extends from the inclined surface 145 in a direction orthogonal to the axis of the first rotating shaft 141, and the forward end thereof is anteroposteriorly opposed to the toner feeding hole 137. The first blade 143 has a size (a length in the radial direction of the first rotating shaft 141) for interfering with the toner feeding hole 137 formed in the partition wall 134.

A plurality of (six in the third embodiment) second blades 144 are provided along the axial direction of the first rotating shaft 141 generally in the form of semicircles protruding from one surface (the upper surface in FIG. 11) of the agitating member body 142, while the sides of the second blades 144 closer to the inclined surface 145 are notched. Further, the second blades 144 are so skewed that the sides closer to the inclined surface 145 are relatively arranged on one side in the width direction and the opposite sides are relatively arranged on another side.

A second agitating member 150 is accommodated in the conveyance chamber 136. The second agitating member 150 has a second rotating shaft 151 extending in the width direction to be rotatably supported by the right and left sidewalls of the conveyance chamber 136 (the toner cartridge 121) and an auger tooth 152, rotating around the second rotating shaft 151, spirally extending from the side of one end portion toward the side of another end portion in the width direction.

A communication port 156 vertically connecting the conveyance chamber 136 with an external device is formed in the lower end portion of the toner cartridge 121, i.e., a lower wall portion 155 of the conveyance chamber 136 to penetrate the wall portion 155.

As shown in FIG. 11, a second shutter 157 identical in shape to the first shutter 126 provided on the developing frame 120 is provided on the outer side of the wall portion 155. A second shutter opening 158 generally identical in shape to the communication port 156 is formed in the second shutter 157. The second shutter 157 is slidable in the peripheral direction of the arc thereof, and displaced between an open position where the second shutter opening 158 is opposed to the communication port 156 and a closed position where the second shutter opening 158 is not opposed to the communication port 156. When the toner cartridge 121 is mounted on the developing frame 120 and the first and second shutters 126 and 157 are on the closed positions respectively, the second shutter opening 158 is arranged on a position opposed to the first shutter opening 127.

(3) Mounting of Toner Cartridge on Developing Frame

Figure 13:
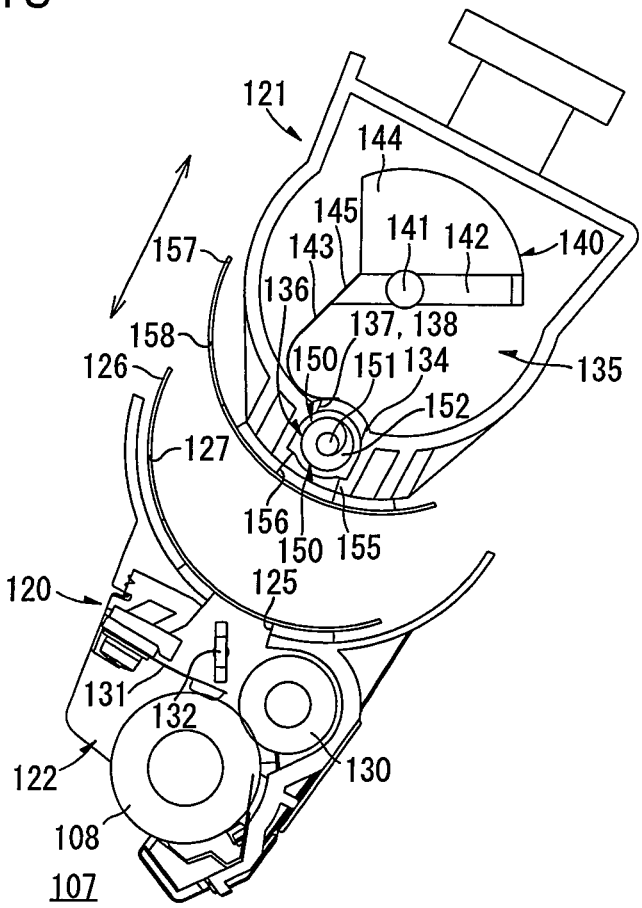
FIG. 13 is a sectional view showing a state in the process of mounting the toner cartridge on a developing frame shown in FIG. 11.

In order to mount the toner cartridge 121 on the developing frame 120, the toner cartridge 121 is first arranged on a position above the developing frame 120, as shown in FIG. 13. In this state, the first and second shutters 126 and 157 are arranged on the closed positions respectively. More specifically, the first shutter 126 blocks the developing chamber side communicating port 125 formed in the developing frame 120 and the second shutter 157 blocks the communication port 156 formed in the toner cartridge 121 when the toner cartridge 121 is not yet mounted on the developing frame 120.

Then, the toner cartridge 121 is moved toward the developing frame 120, and the outer side surface of the arc of the second shutter 157 is brought into close contact with the inner side surface of the arc of the first shutter 126. At this time, both of the first and second shutters 126 and 157 are on the closed positions, and the first and second shutter openings 127 and 158 are opposed to each other.

Thereafter the first and second shutters 126 and 157 are integrally slid to the open positions along the peripheral direction of the arcs thereof. Thus, the developing chamber side communication port 125 is opposed to the first shutter opening 127 and the communication port 156 is opposed to the second shutter opening 158, as shown in FIG. 11. Consequently, the conveyance chamber 136 in the toner cartridge 121 and the developing chamber 122 in the developing frame 120 communicate with each other through the communication port 156, the second shutter opening 158, the first shutter opening 127 and the developing chamber side communication port 125, and the toner cartridge 121 is completely mounted on the developing frame 120.

(4) Conveyance of Toner

A toner path in the developing cartridge 107 is now described mainly with reference to FIG. 12.

The toner in the accommodation chamber 135 is agitated by the plurality of second blades 144 rotating around the axis (the first rotating shaft 141) of the first agitating member 140 and conveyed from left to right, following rotation of the first agitating member 140. Then, the toner is conveyed by the first blade 143 rotating around the first rotating shaft 141 in the direction orthogonal to the axis of the first rotating shaft 141, and partially introduced into the conveyance chamber 136 through the toner feeding hole 137 formed on the right end portion of the partition wall 134.

The toner introduced into the conveyance chamber 136 is conveyed from right to left in the conveyance chamber 136, following rotation of the second agitating member 150. In the process of the conveyance, the toner is introduced into the developing chamber 122 of the developing frame 120 through the communication port 156 formed in the central portion of the lower wall portion 155 of the conveyance chamber 130 in the width direction. At this time, the conveyance chamber 136 and the developing chamber 122 communicate with each other through the communication port 156, the second shutter opening 158, the first shutter opening 127 and the developing chamber side communication port 125.

The toner not introduced into the developing chamber 122 through the communication port 156 is further conveyed leftward in the conveyance chamber 136, following rotation of the second agitating member 150. Then, the toner is introduced from the conveyance chamber 136 into the accommodation chamber 135 through the toner suction hole 138 formed on the left end portion of the partition wall 134.

Thus, the toner is introduced from the accommodation chamber 135 into the developing chamber 122 (the developing frame 120) through the conveyance chamber 136, and circulated between the accommodation chamber 135 and the conveyance chamber 136.

On the other hand, the toner introduced into the developing chamber 122 is agitated in the developing chamber 122 following rotation of the agitator 132, as shown in FIG. 11. Then, the toner is fed to the developing roller 108 through the feed roller 130, due to the contact between the feed roller 130 and the developing roller 108. The toner fed to the developing roller 108 is regulated in thickness by the layer-thickness regulating blade 131 following rotation of the developing roller 108, and carried on the peripheral surface of the developing roller 108 as a thin layer having a constant thickness. When the electrostatic latent image formed on the peripheral surface of the corresponding photosensitive drum 105 (see FIG. 10) is opposed to the developing roller 108, therefore, the toner is fed from the developing roller 108 to the electrostatic latent image, to develop the electrostatic latent image.

3. Functions/Effects

As hereinabove described, the toner cartridge 121 is detachably mounted on the developing frame 120. The toner cartridge 121 is provided with the longitudinal accommodation chamber 135 and the cylindrical conveyance chamber 136 extending in the longitudinal direction of the accommodation chamber 135 through the partition wall 134. The partition wall 134 is provided with the toner feeding hole 137 and the toner suction hole 138 at an interval in the longitudinal direction. The accommodation chamber 135 and the conveyance chamber 136 communicate with each other through the toner feeding hole 137 and the toner suction hole 138.

The accommodation chamber 135 accommodates the toner, while the first agitating member 140 is arranged therein. The first agitating member 140 conveys the toner accommodated in the accommodation chamber 135 to the conveyance chamber 136 from the toner feeding hole 137. The second agitating member 150 is arranged in the conveyance chamber 136. The second agitating member 150 conveys the toner in the conveyance chamber 136 toward the toner suction hole 138 from the toner feeding hole 137.

In the wall portion 155 of the conveyance chamber 136, on the other hand, the communication port 156 is formed between projected portions of the toner feeding hole 137 and the toner suction hole 138 projected on the wall portion 155. The conveyance chamber 136 and the developing frame 120 communicate with each other through the communication port 156.

Thus, the accommodation chamber 135 and the developing frame 120 communicate with each other through the toner feeding hole 137 formed in the partition wall 134, not along a linear path orthogonal to the partition wall 134 but along a bent path passing through the conveyance chamber 136 parallel to the partition wall 134. Therefore, toner conveying force of the first agitating member 140 does not directly act on the feeding of the toner from the communication port 156 to the developing frame 120, and the toner in the conveyance chamber 136 is not positively fed from the communication port 156 to the developing frame 120 when the developing frame 120 is filled with the toner. Thus, the developing frame 120 can be prevented from excess feeding of the toner.

When the developing frame 120 is not filled with the toner, on the other hand, the toner is fed to the developing frame 120 little by little through the communication port 156 while the same is conveyed in the conveyance chamber 136 along the longitudinal direction.

Consequently, the quantity of the toner can be properly kept in the developing frame 120.

The toner feeding hole 137 and the toner suction hole 138 are arranged on both end portions of the partition wall 134 in the longitudinal direction (the width direction) respectively. Further, the communication port 156 is formed in the central portion of the wall portion 155 in the longitudinal direction. Thus, the interval between the toner feeding hole 137 and the toner suction hole 138 can be increased, whereby influence exerted by the toner conveying force of the first agitating member 140 on the feeding of the toner from the communication port 156 to the developing frame 120 can be reduced.

The first agitating member 140 includes the first blade 143. The first blade 143 is provided to be rotatable around the longitudinally extending axis of the first agitating member 140. The toner is conveyed in the direction orthogonal to the axis of the first agitating member 140, following rotation of the first blade 143. Thus, the toner in the accommodation chamber 135 can be fed into the conveyance chamber 136 through the toner feeding hole 137.

The conveyance chamber 136 is provided under the accommodation chamber 135. Thus, the toner can be smoothly fed from the accommodation chamber 135 to the conveyance chamber 136.

-Fourth Embodiment-

Figure 14:
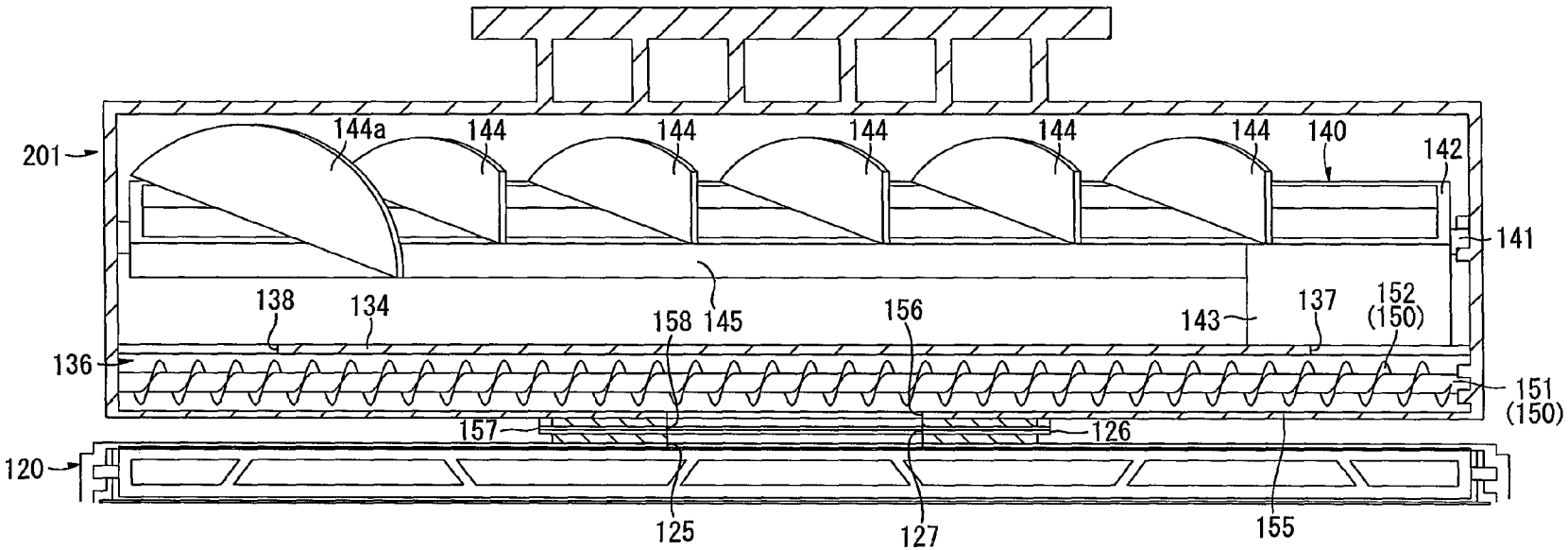
FIG. 14 is a schematic sectional view showing the structure of a toner cartridge according to a fourth embodiment of the present invention.
Figure 15:
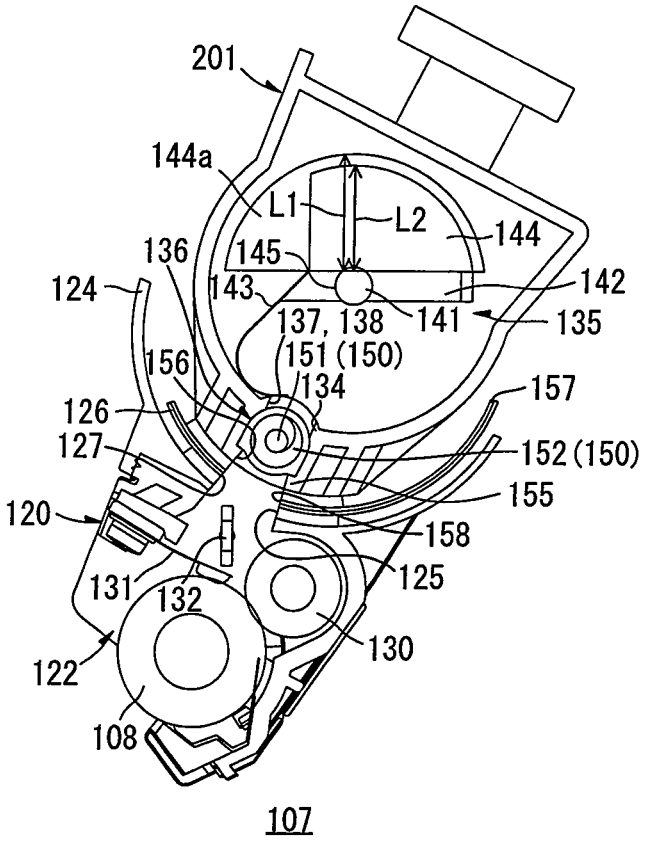
FIG. 15 is a side sectional view of a developing cartridge including the toner cartridge shown in FIG. 14.

A structure shown in FIGS. 14 and 15 is now described mainly with reference to points different from those of the structure shown in FIGS. 11 and 12. Referring to FIGS. 14 and 15, portions corresponding to those shown in FIG. 12 are denoted by reference numerals identical to those of the portions shown in FIG. 12, and redundant description of these portions is omitted.

In a toner cartridge 201 shown in FIGS. 14 and 15, a second blade 144*a* (the leftmost second blade 144) opposed to a toner suction hole 138 is rendered larger in size than the second blades 144 shown in FIGS. 11 and 12 among a plurality of second blades 144.

More specifically, the second blade 144*a* opposed to the toner suction hole 138 is generally in the form of a semicircle protruding from one surface of an agitating member body 142 toward one side, as shown in FIG. 15. The length L1 of the protruding portion of the second blade 144*a* is rendered larger than the length L2 of protruding portions of the remaining second blades 144.

Thus, ability of the second blade 144*a* opposed to the toner suction hole 138 for conveying a toner can be improved, whereby the toner conveyed to an accommodation chamber 135 through the toner suction hole 138 can be positively introduced.

-Fifth Embodiment-

Figure 16:
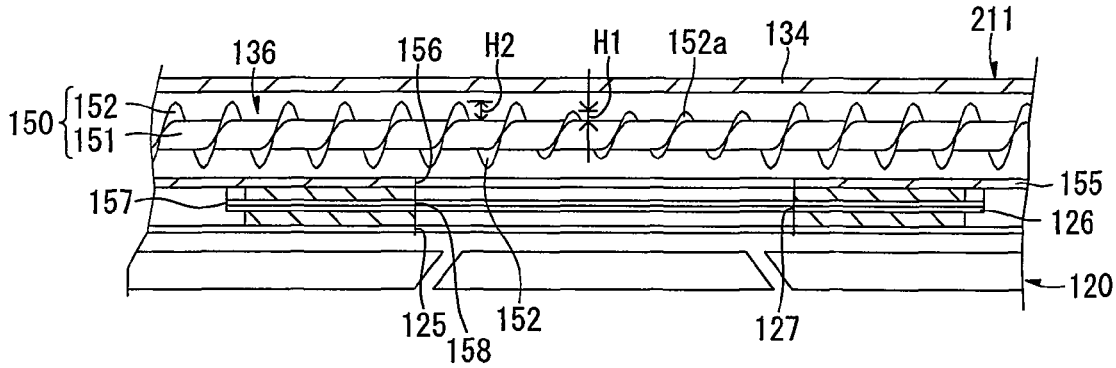
FIG. 16 is a partially enlarged sectional view of a toner cartridge according to a fifth embodiment of the present invention.

In a toner cartridge 211 shown in FIG. 16, the length H1 of a portion of an auger tooth 152*a* of a second agitating member 150 opposed to a communication port 156 in the radial direction (the radial direction of a second rotating shaft 151) is rendered smaller than the radial length H2 of the remaining portions of the auger tooth 152. In the second agitating member 150, therefore, toner conveying force in the portion opposed to the communication port 156 is smaller than that in the remaining portions.

Thus, the quantity of the toner fed to a developing frame 120 through the communication port 156 can be reduced, whereby the developing frame 120 can be prevented from excess feeding of the toner.

-Sixth Embodiment-

Figure 17:
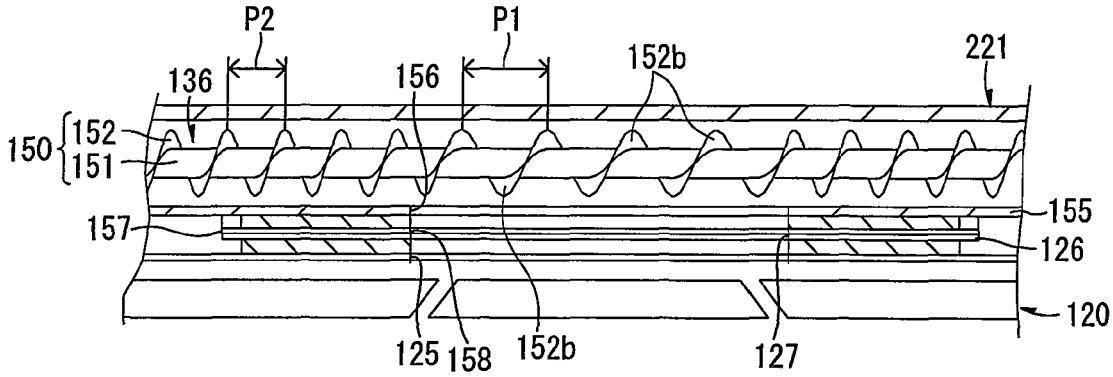
FIG. 17 is a partially enlarged sectional view of a toner cartridge according to a sixth embodiment of the present invention.

In a toner cartridge 221 shown in FIG. 17, a pitch P1 of a portion of an auger tooth 152*b* of a second agitating member 150 opposed to a communication port 156 is rendered larger than a pitch P2 of the remaining portions of the auger tooth 152. In the second agitating member 150, therefore, toner conveying force in the portion opposed to the communication port 156 is smaller than that in the remaining portions.

Thus, the quantity of the toner fed to a developing frame 120 through the communication port 156 can be reduced, whereby the developing frame 120 can be prevented from excess feeding of the toner.

-Seventh Embodiment-

Figure 18:
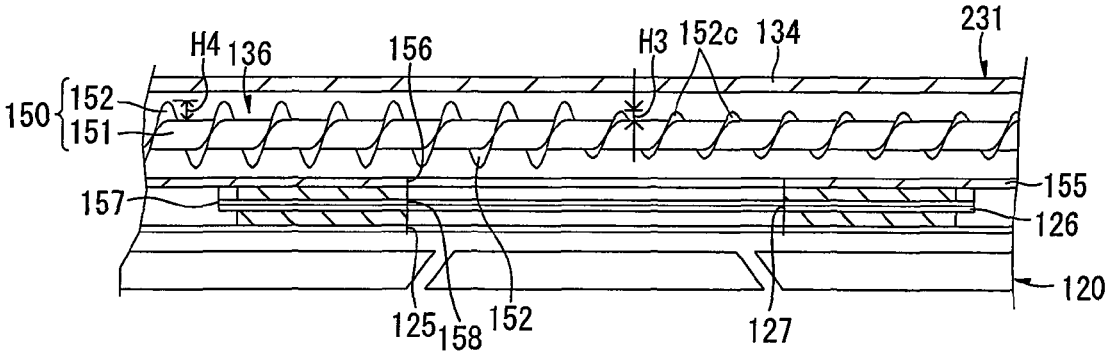
FIG. 18 is a partially enlarged sectional view of a toner cartridge according to a seventh embodiment of the present invention.

In a toner cartridge 231 shown in FIG. 18, the length H3 of a portion of an auger tooth 152*c* of a second agitating member 150 formed on an upstream side (the right side) of a communication port 156 in the radial direction (the radial direction of a second rotating shaft 151) is rendered smaller than the length H4 of a portion of an auger tooth 152 formed on a downstream side (the left side) of the communication port 156 in the second agitating member 150. In the second agitating member 150, therefore, toner conveying force on the downstream side of the communication port 156 is larger than that on the upstream side of the communication port 156.

When a developing frame 120 is filled with the toner, therefore, the toner overflowing into a conveyance chamber 136 from the communication port 156 can be excellently conveyed toward the downstream side, and can be returned to an accommodation chamber 135 through a toner suction hole 138 (see FIG. 12).

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. A developing apparatus comprising:

a developing frame providing a developing chamber, a conveyance chamber, and a storing chamber configured to store a developer fed into the developing chamber, the storing chamber including a top and a bottom;

a developing roller accommodated in the developing chamber, the developing roller configured to carry the developer;

a feed roller accommodated in the developing chamber and configured to feed the developer to the developing roller;

a first agitating member accommodated in the storing chamber and configured to agitate the developer by rotating in a prescribed rotational direction;

an accommodation chamber frame physically separable from the developing frame and internally providing a developer accommodation chamber configured to accommodate a developer to be fed into the storing chamber;

a second agitating member accommodated in the developer accommodation chamber and configured to agitate the developer in the developer accommodation chamber;

a wall portion defining the conveyance chamber and provided between the storing chamber and the developer accommodation chamber and formed with an opening to face the storing chamber at a position above an upper end portion of the feed roller, wherein the opening is disposed below the top of the storing chamber; and a conveyance member disposed in the conveyance chamber between the opening of the wall portion and the developer accommodation chamber along a path in which toner is fed from the developer accommodation chamber to the storing chamber, wherein the conveyance member is configured to convey the developer in an axial direction of the developing roller.

2. The developing apparatus according to claim 1, wherein the conveyance member is an auger having a rotating shaft extending in the axial direction for conveying the developer by rotating around the rotating shaft.

3. The developing apparatus according to claim 1, wherein:

the first agitating member includes a flexible agitating blade, and the opening is formed at a position interfering with the agitating blade.

4. The developing apparatus according to claim 1, wherein:

the opening is directed downward.

5. The developing apparatus according to claim 1, wherein:

the conveyance chamber is in the form of a horizontally extending cylinder.

6. The developing apparatus according to claim 1, wherein:

the developer accommodation chamber is arranged on a side of the conveyance chamber, and the conveyance chamber is arranged on a side of the storing chamber.

7. The developing apparatus according to claim 1, wherein the conveyance chamber further includes a communication port configured to communicate with the developer accommodation chamber.

8. The developing apparatus according to claim 7, wherein:

the conveyance member is configured to unidirectionally convey the developer in the axial direction, the opening is formed on a position opposed to a central portion of the conveyance member in the axial direction, and the communication port is formed at a position opposed to each end portion of the conveyance member in the axial direction.

9. The developing apparatus according to claim 7, wherein:

the conveyance member is configured to unidirectionally convey the developer in the axial direction, and the opening and the communication port are formed at positions deviating from each other in the axial direction.

10. The developing apparatus according to claim 7, wherein the opening is directed downward.

11. The developing apparatus according to claim 10, wherein the conveyance member is configured to unidirectionally convey the developer in the axial direction, and the opening and the communication port are formed at positions deviating from each other in the axial direction.

12. The developing apparatus according to claim 7, wherein the communication port is different from the opening and the conveyance chamber is different from the storing chamber.

* * * * *